United States Patent [19]

Hung

[11] 3,961,473

[45] June 8, 1976

[54] ELECTRONIC CHESS TIMER

[76] Inventor: George Hung, 339 Harwick Road, Rochester, N.Y. 14609

[22] Filed: Mar. 6, 1975

[21] Appl. No.: 556,167

[52] U.S. Cl. ..... 58/145 D; 58/23 R; 58/39.5

[51] Int. Cl.[2] ..... G04B 5/20

[58] Field of Search ..... 58/23 R, 50 R, 145 D, 58/21.13, 21.155, 21.15, 39.5, 145 R, 153; 273/148 R; 340/309.1, 309.4, 309.5

[56] References Cited

UNITED STATES PATENTS

| | | | |
|---|---|---|---|
| 3,499,279 | 3/1970 | Abe et al. | 58/145 R X |
| 3,646,751 | 3/1972 | Purland et al. | 58/50 R X |
| 3,662,535 | 5/1972 | Hedrick et al. | 58/39.5 |
| 3,664,116 | 5/1972 | Emerson et al. | 58/R X |
| 3,698,180 | 10/1972 | Klein | 58/145 D |
| 3,795,099 | 3/1974 | Tsuruishi | 58/153 X |
| 3,878,675 | 4/1975 | Prociuk | 58/145 D |

*Primary Examiner*—Ulysses Weldon

*Attorney, Agent, or Firm*—Shlesinger, Fitzsimmons & Shlesinger

[57] ABSTRACT

The timer comprises an oscillator and a pair of memories for selectively receiving and storing signals from the oscillator. Each memory is connected to a display which indicates in digital form, and to the nearest tenth, the number of minutes of play that are represented by the signals stored in the associated memory. Before the start of a chess game, each player pushes one of two switches which directs the oscillator signals to the count-down terminal on the associated memory to store therein signals corresponding to the amount of minutes that player is allotted for making a certain number of moves. When play commences the players alternately operate a second pair of switches, one after each move, selectively to direct the signals to count-down terminals on said memories to continuously update the previously stored signals of a memory during the time the associated player is making a move. When a memory registers zero, a blanking circuit causes the corresponding display to flash on and off to indicate time has run out.

10 Claims, 1 Drawing Figure

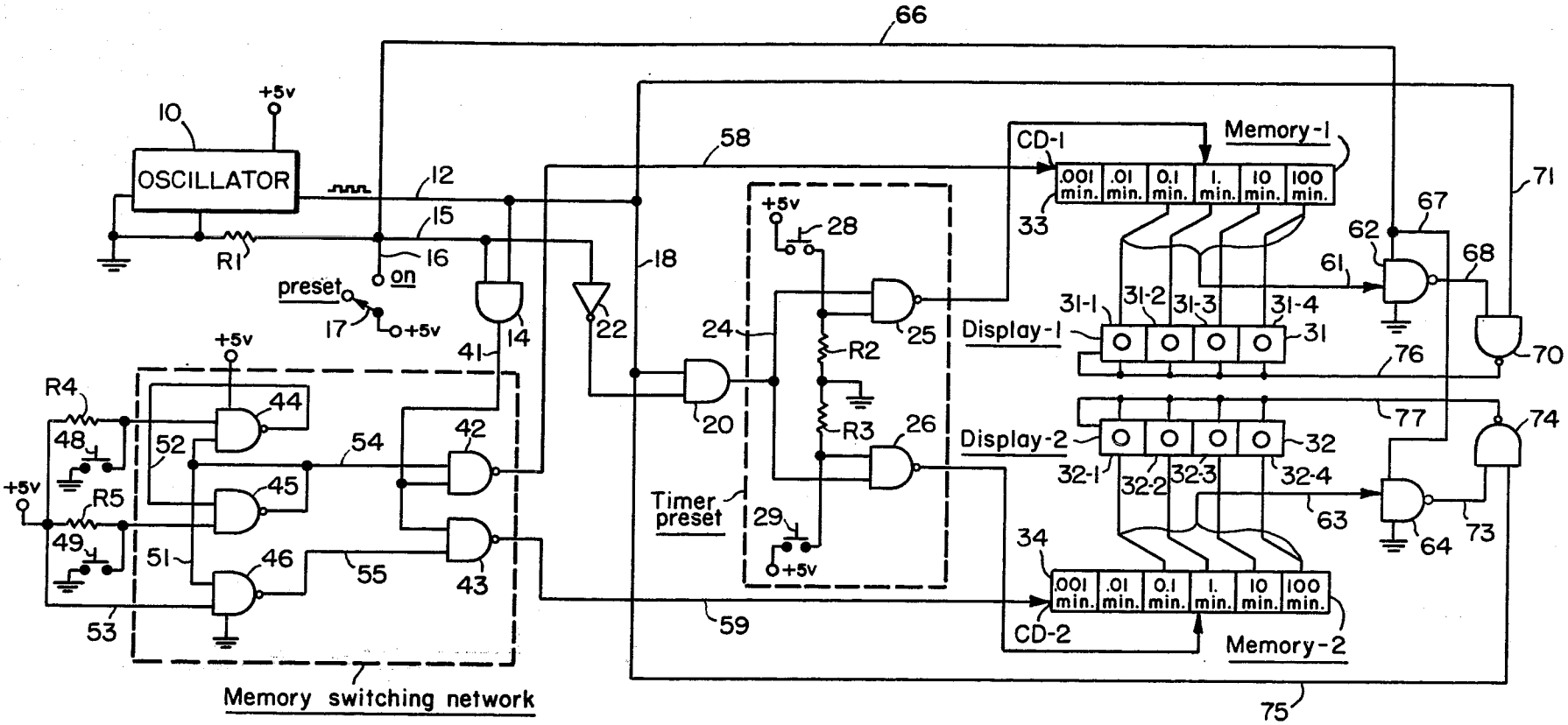
Memory-1
Memory-2
CD-1
CD-2
Display-1
Display-2
Timer preset
Memory switching network
OSCILLATOR
preset
on
+5v
R1
R2
R3
R4
R5
.001 min.
.01 min.
0.1 min.
1. min.
10 min.
100 min.

ELECTRONIC CHESS TIMER

This invention relates to electronic timers, and more particularly a presettable dual timer for selectively timing, for example, the moves of two chess players.

While "time" is not necessarily of essence in a social game of chess, nevertheless the opposite is true for tournament play. It is well known, for example, that tournament players are required to make a certain number of moves within a given period of time. For this purpose it is conventional to employ a pair of clocks or timers, which are alternately started and stopped by the players to time their respective moves.

Major disadvantages of prior such clocks include their relative inaccuracy for match purposes, and the difficulty in setting and accurately reading their sweep hands. Moreover, most such clocks have tended to be rather noisy and distracting to the players, and have required each player to estimate the time remaining in the period allowed for his or her play.

It is an object of this invention, therefore, to provide a presettable, electronic chess clock or timer for timing the moves of the two players of a chess match or the like.

Another object of this invention is to provide a timer of the type described which contains dual displays for illustrating in decimal form the time of play remaining for each of the players in a match.

Still another object of this invention is to provide a timer of the type described which operates silently and which at any moment can be adjusted to set or reset the playing times of each player in minutes.

Other objects of the invention will be apparent hereinafter from the specification and from the recital of the appended claims, particularly when read in conjunction with the accompanying drawing.

In the drawing the single FIGURE is a wiring diagram illustrating a timer made according to one embodiment of this invention.

Referring now to the drawing by numerals of reference, 10 denotes an oscillator comprising a conventional bistable multivibrator that is capable of generating, for example, a 16.67 Hz timing squarewave signal. The oscillator is energized from a positive five volt DC power source, which may be provided by a battery or a rectifier energized from an AC source.

When the oscillator 10 is energized, its output signal is applied through a line 12 to one of two inputs to an AND gate 14, the other input of which is connected through a line 15 and a resistance R1 to ground. Line 15 is also connected by a line 16 to an ON terminal of a single-pole, double-throw switch 17. The pivoted end of this switch is connected to the five volt power supply; and its opposite end is pivotal selectively into engagement with the ON terminal, or with a PRESET terminal, which is not connected in any other circuit. When switch 17 is engaged with the PRESET terminal, one of the two inputs to gate 14 is grounded through line 15 and the resistance R1, so that gate 14 is not enabled, despite the application of the oscillator signal to its other input.

The output of the oscillator 10 is applied also by the line 12 and a line 18 to one of two inputs to an AND gate 20, the other input of which is connected to the output of an inverter 22. Whenever the switch 17 is in its PRESET position, the input to the inverter 22 is held at ground potential by the line 15, so that the output of the inverter 22 is driven to a logic 1. Under these circumstances, each time a signal is applied from the oscillator to the other input of gate 20 by the line 18, the gate 20 is enabled and produces at its output a signal similar to the oscillator signal. The signal output of gate 20 is applied by line 24 to one input of each of two NAND gates 25 and 26, which form part of a timer preset circuit. The other of the inputs to the gates 25 and 26 are connected at one side through resistances R2 and R3, respectively, to ground, and at their opposite sides are connected selectively through pushbutton switches 28 and 29, respectively, to the five volt power supply. When the switches 28 and 29 are open, the gates 25 and 26 are not enabled, because the other inputs thereto are maintained at ground potential through the resistors R2 and R3. At such time, therefore, the appearance of signals on the line 24 will have no effect on the outputs of gates 25 and 26.

The timer preset circuit may be employed selectively to preset one of two decimal displays 31 and 32, which are driven by the outputs of two memories or registers 33 and 34, respectively. Each memory comprises a series of six divide-by-ten (decade) counters or frequency dividers serially connected in successive stages to provide a register or memory that has a range of 999.999 minutes and a resolution of 0.06 second. As denoted by the legends in the drawing, each memory 33 and 34 is capable of storing signals representing minutes and decimal fractions thereof. Signals stored in the first stage of each memory, for example, are representative of thousandths of a minute, and the sixth stage stores signals representing hundreds of minutes. The 4-bit binary outputs of each of the third (0.1 minute), fourth (1 min.), fifth (10 min.) and sixth (100 min.) stages of each memory 33 and 34 are applied in known manner to conventional decoders, which may form part of each display 31 and 32.

Each display 31 and 32 may comprise four different multisegment decimal displays 31-1, 31-2, 31-3, 31-4, and 32-1, 32-2, 32-3, 32-4, respectively. The signals from the third, fourth, fifth and sixth stages of memory 33 are used selectively to energize and illuminate the segments of the decimal displays 31-1, 31-2, 31-3 and 31-4, respectively. For example, the signals from the third stage of memory 33, therefore, are decoded at the display and selectively energize and illuminate the segments of the group 31-1 to form any of the numerals zero through 9, thereby to provide an illuminated decimal representation of the tenths of minutes represented by the signals stored in this third stage of memory 33. Similarly, the signals from the fourth, fifth and sixth stages of memory 33 will energize the segments in the decimal displays 31-2, 31-3, and 31-4 to represent with decimal numerals the number of minutes, tens of minutes and hundreds of minutes, respectively, represented by the signals stored in these stages of the memory.

It will be understood that display 32 operates in a similar manner to display numerically and in decimal form, the number of minutes and decimal fractions thereof that are represented by the signals stored in the memory 34. Of course when the memories 33 and 34 are empty, their associated decimal displays will register zeros, as shown for example in the drawing.

When the oscillator 10 is operating, and switch 17 is in its PRESET position as shown in the drawing, signals can be stored in either or both of the memories 33 and 34 by depressing one or both of the switches 28 and 29. Whenever one of these switches is closed, it connects the other or second input to the associated gate 25 or 26 to the five volt power supply, so that each such input then becomes a logic 1. For example, when the switch 28 is closed, gate 25 is enabled so that the oscillator signal is gated through gates 20 and 25 to a shifting terminal or input of the fourth stage (the 1 min. stage) of memory 33. In the illustrated embodiment the signals are applied to a count-down terminal on the fourth stage, but it will be apparent that the contents of the memory could also be changed by applying the oscillator signal to a count-up terminal on the memory, the purpose being in either case to preset the memory to a given interval as indicated by its associated display. The switch 28 may be held closed until the desired number of minutes have been stored in memory 33, after which switch 28 is released. The display 31 now indicates to the nearest tenth of a minute the number of minutes it will take to empty or count down the memory 33 to its empty or zero position.

Similarly, the switch 29 can be held closed to enable the gate 26 long enough to store the desired number of minutes in the memory 34. As with gate 25, the output of gate 26 is applied to a shifting terminal on the fourth stage of memory 34 so that the memory can be loaded much faster than if the signals were to be applied to a shifting terminal on one of the first three stages of the memory. Also as above, the display 32 will indicate to the nearest tenth of a minute the amount of time it will take to empty or zero the memory 34.

To count down or empty the memories 33 and 34, switch 17 is switched to its ON position so that signals from the oscillator 10 can be applied selectively to the count down terminals CD-1 and CD-2 of the memories 33 and 34, respectively. When switch 17 is engaged with the ON terminal, the five volt power supply is applied through lines 16 and 15 to one input of the gate 14 so that this gate is now enabled, whereby as the oscillator signal appears at the other input of this gate, it is transferred to the output of the gate. The signals from the gate 14 are applied by its output line 41 to one input of each of two NAND gates 42 and 43, which form part of a bistable multivibrator or memory switching network.

The other two inputs to the gates 42 and 43, respectively, are controlled by three NAND gates 44, 45 and 46. One of the inputs to gate 44 is connected through a resistor R4 to the five volt power supply, and selectively through a pushbutton switch 48 to ground. One of the inputs to the gate 45 is also connected through a resistor R5 to the five volt power supply, and selectively through another pushbutton switch 49 to ground. The other input of gate 44 is connected by a line 51 to one of the inputs of the gate 46; and the other input of the gate 45 is connected by a line 52 to the output of gate 44. The other or remaining input of gate 46 is connected by a line 53 to the five volt power supply. The output of gate 45 is connected by a line 54 to the other input of the gate 42, and also to the line 51, so that the signal output of the gate 45 is applied to one input of each of the gates 44 and 46. The output of gate 46 is applied by a line 55 to the other input of gate 43. The output of gate 42 is connected by a line 58 to the count-down terminal CD-1 of the memory 33; and the output of the gate 43 is connected by a line 59 to the count-down terminal CD-2 of the memory 34.

Whenever power is applied to the system, one of the outputs of the gates 45 and 46 will be high or a logic 1, and the other will be low, or a logic zero, depending upon which of the two switches 48 and 49 was last closed. Assuming that the output of gate 45 is high, it will maintain one of the inputs to the gate 44 high through lines 54 and 51, at the same time that the other input to gate 44 is maintained high through the resistor R4 to 5 volts, so that the output of gate 44 at this time is therefore low or a logic 0. The logic 1 output of gate 45 is also applied at this time through line 51 to one of the inputs of gate 46, the other of which is connected to the five volt power supply, so that at this time the output of gate 46 is also low or 0 logic. With a logic zero being applied through line 52 to one of the inputs of gate 45, while the other input thereof is maintained at a logic 1 through the resistor R5 to the five volt power supply, the output of gate 45 remains high and is applied through the line 54 to one of the inputs of gate 42 until switch 48 is thereafter closed. Under these circumstances gate 42 will be enabled whenever the oscillator signal is gated through the gate 14 to the line 41. The signal on line 41, however, will not enable the gate 43 at this time because the other input to gate 43 is at a logic 0.

When switch 48 is thereafter closed momentarily, it places the one input to the gate 44 at ground potential, or logic zero thereby enabling gate 44 to apply a logic 1 to line 52. At such time the two inputs to gate 45 become the same (logic 1), thereby causing the output of gate 45 to drop to a logic 0, thereby removing the enabling signal from lines 54 and 51, so that one of the inputs to the gate 46 becomes a logic zero, thereby switching the output of gate 46 to a logic 1. This swings line 55 high so that gate 43 is now partially enabled. At the same time, when the line 51 swings to a logic 0, the input to the gate 44 becomes complimentary, so that its output swings high, to place line 52 at a logic 1, and the minute the switch 48 is released to return to its opened position, both inputs to the gate 44 will be different thereby to maintain its output at a logic 1 until such time that the switch 49 is momentarally closed to switch the output of gate 45 back to a logic 1. Thus whenever power is applied to the system, one or the other of the two gates 42 and 43 is partially enabled as the result of the appearance of a logic 1 on the line 54 or 55, the other of these two lines being at this time at a logic 0. Therefore, whenever the gate 14 is enabled the oscillator output signal will be gated through one of the gates 42 or 43 to the corresponding count-down terminal on one of the memories 33 or 34.

For providing a visual indication of the signals stored in the memories 33 and 34, the four-bit outputs of each of the third, fourth, fifth and sixth stages of memory 33 are applied, as denoted diagrammatically by line 61 to the inputs of a multiple input NAND gate 62. Similarly, the outputs of the third, fourth, fifth and sixth stages of the memory 34 are applied, as represented diagrammatically by the line 63, to the inputs of a multiple input NAND gate 64. Power is supplied to the NAND gates 62 and 64 from the ON terminal of switch 17 through lines 16, 66 and 67, so that gates 62 and 64 are operable only when switch 17 is in its ON position. The output of gate 62 is connected by a line 68 to one of the inputs of the NAND gate 70, the other input of which is connected by a line 71 and the line 12 to the output of the oscillator 10. The output of gate 64 is connected by a line 73 to one input of a NAND gate 74, the other input of which is connected by a line 75, and lines 18 and 12 to the output of the oscillator 10. The outputs of the gates 70 and 74 are connected by lines 76 and 77, respectively, to the blanking inputs of the displays 31 and 32, respectively.

Whenever the oscillator 10 is energized, the output signals thereof will be applied through lines 12 and 71 to one of the inputs of gate 70 partially to enable this gate; and similarly, the output of the oscillator will be applied through lines 12, 18 and 75 to one input of gate 74, partially to enable this gate. Whenever the third, fourth, fifth and sixth stages of memory 33 become empty, or zero, the signals on line 61 will enable gate 62, the output of which is then applied through line 68 fully to enable gate 70, so that the signals from oscillator 10 are then applied through line 76 to the blanking input of display 31. This causes the display 31 to flash on and off to indicate, for example, that the corresponding stages of the memory 33 have been counted down to zero. Similarly, when the third, fourth, fifth and sixth stages of memory 34 have all been counted down to zero, the signals on line 63 enable gate 64, the output of which then enables gate 74 each time the oscillator signal appears on line 75. The oscillator signal thus appears on line 77 and are applied to the blanking input of display 32 so that this display is also caused to flash on and off when the associated stages of the memory 34 are all zeroed.

In use, to provide a "time remaining" indicator for a chess game, for example, the timer is energized by operating any conventional, manually operable switching device (not illustrated) which may be employed selectively to connect the illustrated 5 v. terminals to a battery or recifier output. Assuming that the two memories are emptied or zeroed at the start, the oscillator signals on line 12 will be applied to the blanking inputs of each of the displays 31 and 32, so that the displays will be flashing on and off. If one or the other of the displays indicates that some signals remain stored in its memory, the operator may swing switch 17 to its ON position. As noted above, this will automatically cause the oscillator signal to be applied through either the gate 42 or 43 (depending upon which of the switches 48 and 49 was last depressed) to the corresponding count-down terminal on the memory 33 or 34. This will cause the associated memory to be counted-down to zero if not already there. If the count-down signal is not being applied to the proper memory, the operator may push either the button 48 or 49 to switch the output of the memory switching network from one to the other of the memories 33 and 34 to cause the associated memory to count down to zero.

When this has been done, and both memories 33 and 34 have been zeroed as indicated by the flashing of their associated displays 31 and 32, the arm of switch 17 is swung to its PRESET position. This disenables gate 14, so that the oscillator signals cannot be applied as count down signals through gates 42 and 43 to the memories; and it also disenables the gates 62 and 64, so that the signals are removed from the blanking inputs to the displays 31 and 32, which therefore stop flashing.

At this time the switches 28 and 29 are then closed, simultaneously or otherwise, to enable gates 25 and 26 long enough to load each memory 33 and 34 with signals corresponding to the amount of time which each of the two players is to be allotted for making a predetermined number of moves. For example, if both players are to be given 2½ hours to make forty moves, each switch 28 and 29 is held closed until each display 31 and 32 indicates that 150 minutes have been stored in each memory. The switches 28 and 29 are then released to disenable the gates 25 and 26.

Before moving the switch 17 to its ON position, it must be decided which of the two players is to commence play first. Assuming it is to be the player whose time is stored in memory 33, the opponent pushes switch 49 to ground one of the inputs to gate 45. If the output of gate 45 is high at this time, it will remain so, but if it is low and the output of gate 46 is high, the gates 45 and 46 will be switched so that the output of gate 45 becomes high and the output of gate 46 becomes low. With the output of gate 45 high, the gate 42 is partially enabled, and will remain so until switch 48 is pushed at some future time. After this selection has been made the operating arm of switch 17 is swung to its ON position which indicates the start of the match. As soon as switch 17 assumes its ON position gate 14 becomes enabled with each signal from the oscillator 10, so that the oscillator signals are therefore gated through gates 14 and 42 to the count-down terminal CD-1 of the memory 33. This player's display 31, therefore, begins to count down in tenths of a minute, so that whenever the player wishes to know his overall time remaining, he need only glance at the display 31 to determine this time to the tenth of a minute.

After the first player has made his first move he should push the button 48 to switch the count down signals to his opponent's timer. This operation, as noted above, causes the output of gate 45 to swing low, while the output of the gate 46 becomes a logic 1, thus enabling gate 43 so that the oscillator signals from the output of gate 14 are now gated through gate 43 to the count-down terminal CD-2 of memory 34. The opponent or second player is now working against his portion of the clock or timer, while the timer for the first player has stopped counting down. After the second player makes his first move, he then pushes the switch 49 once again to switch back the countdown signals from the oscillator 10 to the count down input terminal CD-1 of the first player's memory 33.

The above-described steps are repeated until the match is completed, or until one of the memories has completely counted down to its zero state, at which time signals will be applied to the blanking input of the associated display to cause the associated display to flash on and off, thereby to show that the player has run out of time.

Whenever necessary, the timer can be stopped by moving the switch 17 back to its PRESET position, thereby interrupting the count down signals to the memories. Then the time remaining for one or the other of the players can be reset or increased, if necessary, by closing one or the other of the switches 28 and 29.

From the foregoing it will be apparent that the instant invention provides an extremely accurate timing device for indicating visually the exact time remaining for each player to complete his moves during a chess match, or the like. Unlike prior such devices, it is not necessary for each player to estimate the time remaining to complete their moves, because the digital displays 31 and 32 readily indicate at any instant the exact game time remaining for each player to the tenth of a minute. Moreover, the timer device is extremely silent and requires very little power for operation. The switches 28 and 29 provide ready means for resetting the timer memories for desired time periods; and the blanking circuits provide readily visible means for indicating when a player has run out of time.

While this application has described in detail only a single embodiment of this invention, modifications thereof should be readily apparent to one skilled in the art, and this application is intended to cover any such modifications as may fall within the purview of this application and the scope of the appended claims.

Having thus described my invention, what I claim is:

1. A digital timer for indicating the time for completing moves in a chess match, comprising a source of electrical signals, a pair of registers for storing said signals in bit form, presetting means operable for selectively directing signals from said source to said registers for storage therein, means coupled to said source of electrical signals, for controlling the shifting of the stored signals serially out of said registers to reduce the quantities of signals previously stored therein, means for selectively connecting said shifting means to said registers one at a time to reduce the signals stored therein, and a pair of electrical displays connected to said registers and operative separately to indicate in digital form for each register the operating time in minutes it will take said shifting means to remove all remaining stored signals from the associated register.

2. A digital timer as defined in claim 1, including means interposed between said source of electrical signals and said registers, for intermittently and selectively energizing and de-energizing said displays, when the associated register has been shifted to zero state by said shifting means, thereby to cause the display associated with the last-named register to flash on and off.

3. A digital timer as defined in claim 1, including first switch means for selectively operating said presetting means and said control shifting means one at a time.

4. A digital timer as defined in claim 3, wherein said presetting means includes second switch means connected to shifting terminals on said registers and manually operable, when said presetting means is in operation, selectively to direct said signals to said terminals for storage in the associated register, and said control shifting means includes third switch means connected to count-down terminals on said register and operable, when said shifting means is in operation, selectively to direct said signals to said count-down terminals to remove previously stored signals from the associated register.

5. A digital timer as defined in claim 4, wherein said second switch means includes means for directing said signals simultaneously to shifting terminals on both of said registers and said third switch means includes means for directing said signals to the shifting terminal of only one of said registers at a time.

6. A digital timer as defined in claim 4, wherein each of said registers comprises a plurality of decade counters connected in series, said second switch means comprises a pair of manually operable switches for selectively directing said signals to the shifting terminals on predetermined counters in said registers, and each of said displays is connected to the outputs of at least certain of the counters of the associated register to display in decimal form the number of minutes represented by the signals stored in the last-named register.

7. A digital timer as defined in claim 6, including a pair of blanking circuits interposed between the outputs of said certain counters and a pair of blanking inputs on said displays, and each of said circuits including means operative in response to the said source of electrical signal, whenever said shifting means is operating and said certain counters of the associated register have zeroed, to apply said signals to the blanking terminal of the associated display to cause the latter to flash on and off.

8. A digital timer for chess matches, comprising a pair of signal-responsive memories, a source of electrical signals of predetermined frequency, means operable for selectively applying said signals to the inputs of said memories for storage therein, the stored signals in each of said memories representing a predetermined interval of time, means coupled to said source of electrical signal for selectively controlling the removal of stored signals alternately from one and then the other of said memories, means for selectively operating said signal applying means and said signal control removing means, first to store signals in, and then to remove signals from, said registers, and a pair of displays connected to said memories and indicating, respectively, and in digital form at any instant, the interval of time represented by the stored signals then remaining in the associated memory.

9. A digital timer as defined in claim 8, including means coupled to said memories for automatically connecting said signal source to a blanking terminal on each of said displays, when the memory associated therewith has no signals stored therein, thereby to cause the associated display to blink on and off.

10. A digital timer as defined in claim 8, wherein each of said memories comprises a multi-stage decimal register capable of storing said signals in bit form, and each of said displays comprises a plurality of multisegment display elements driven by the bits stored in the associated memory to display in minutes and decimal fractions thereof the time interval represented by said stored bits.

* * * * *